US005806779A

United States Patent [19]

Crum

[11] Patent Number: 5,806,779

[45] Date of Patent: Sep. 15, 1998

[54] FENCE DISPENSING APPARATUS AND METHOD FOR ITS USE

[76] Inventor: Lloyd E. Crum, 3900 Cambridge Rd., Marietta, Ohio 45750

[21] Appl. No.: 890,188

[22] Filed: Jul. 9, 1997

Related U.S. Application Data

[63] Continuation of Ser. No. 567,963, Dec. 6, 1995, abandoned.

[51] Int. Cl.[6] ..... B65H 75/42

[52] U.S. Cl. ..... 242/399.1; 242/403; 242/557; 242/533.8; 242/419.4

[58] Field of Search ..... 242/399.1, 403, 242/557, 533.8, 396.5, 419.4, 566; 414/911, 24.6; 254/213, 216, 221, 223, 225, 226

[56] References Cited

U.S. PATENT DOCUMENTS

| | | | |
|---|---|---|---|
| 2,611,498 | 9/1952 | Broersma | 414/911 X |
| 2,914,270 | 11/1959 | Parker et al. | 242/399.1 X |
| 3,048,348 | 8/1962 | Griffin | 242/403 X |
| 3,896,957 | 7/1975 | Sinclair | 414/911 X |
| 4,930,718 | 6/1990 | Lancour et al. | 242/557 |
| 5,163,634 | 11/1992 | Moon et al. | 242/557 X |

*Primary Examiner*—Daniel P. Stodola
*Assistant Examiner*—Gregory J. Strimbu
*Attorney, Agent, or Firm*—John L. Gray; Kegler,Brown,Hill & Ritter

[57] ABSTRACT

An apparatus and method for unrolling fencing for use with a vehicle. The apparatus comprises a frame with an unright support and a bottom, a first and second gate, each gate having a back edge and a front edge, the back edge of each gate pivotally connected to the frame such that the gates can open and close, with the front edge of the first gate adjacent to the front edge of the second gate when the gates are closed. The apparatus preferably includes hydraulic cylinders for opening and closing the gates. It also preferably includes a rotatable bottom plate. The bottom plate optionally has a pin attached to it whereby a roll of fencing having a center hole can be placed on the bottom plate over the pin and unwound. The apparatus preferably includes an adapter attached to the frame for attachment to the vehicle.

3 Claims, 4 Drawing Sheets

FENCE DISPENSING APPARATUS AND METHOD FOR ITS USE

This application is a continuation, of application number 08/567,963 filed Dec. 6. 1995, now abandoned.

BACKGROUND OF THE INVENTION

This invention relates to a fence handler, and more particularly to a fence handler which can be used with fencing rolls either with or without a center hole.

The installation of chain link fence requires the handling of large, heavy rolls of fencing. The rolls must be unwound, temporarily attached to the posts, spliced together, stretched, and finally permanently attached to the posts. Chain link fencing comes in 50 foot long rolls of varying heights. The rolls range in weight from about 215 pounds for a six foot high roll to about 445 pounds for a twelve foot high roll. It takes two or three people to unroll and stand up the six, seven, and eight foot tall rolls, and four people to handle the ten and twelve foot rolls.

Because of the difficulties in handling these rolls, various fencing dispensers have been developed. For example, U.S. Pat. Nos. 3,632,054, Heppelmann et al., and 5,163,634, Moon et al., show fencing dispensers which can be attached to vehicles. These dispensers require fencing which has a center hole in them. While most rolls of fencing have center holes, chain link fence rolls do not.

U.S. Pat. No. 4,930,718, Lancour et al., shows a fencing dispenser which can be used with rolls lacking a center hole. However, in this case, the roll must be placed in the cage manually, either by lifting the roll and placing it inside the cage or by rolling it across the gate and into the cage. In either situation, rolls weighing over 200 pounds must be moved manually, requiring several people and raising the possibility of injury.

SUMMARY OF THE INVENTION

An apparatus for unrolling fencing for use with a vehicle is disclosed. The apparatus comprises a frame having an upright support and a bottom, a first and second gate, each gate having a back edge and a front edge, the back edge of each gate pivotally connected to the frame such that the gates can open and close, the front edge of each gate being located opposite the back edge, and the front edge of the first gate being adjacent to the front edge of the second gate when the gates are closed, and a bottom plate attached to the frame. The apparatus preferably includes an hydraulic cylinder for opening and closing the gates.

The bottom plate is preferably rotatable. The bottom plate optionally has a pin attached to it whereby a roll of fencing having a center hole can be placed on the bottom plate over the pin and unwound. The apparatus preferably includes an adapter attached to the frame for attachment to a vehicle.

A method of unrolling wire fence is also disclosed. The method comprises (1) picking up a roll of wire fence in an apparatus having a frame, a first and second gate, each gate having a back edge and a front edge, the back edge of each gate pivotally connected to the frame such that the gates can open and close, the front edge of each gate being located opposite the back edge, and the front edge of the first gate being adjacent to the front edge of the second gate when the gates are closed and a bottom plate attached to the frame, (2) forming a gap between the front edges of the gates so that the wire fence can be unrolled through the gap, (3) unrolling the wire fence, and (4) closing the gates so that the gap is closed and the front edges of the gates grip the wire fence so that the wire fence which has been unrolled can be tightened against the fence supports. The method preferably includes placing the apparatus horizontally over the roll of wire fence, closing the gates around the roll, and tilting the roll to a vertical position.

DETAILED DESCRIPTION OF THE INVENTION

Figure 1:
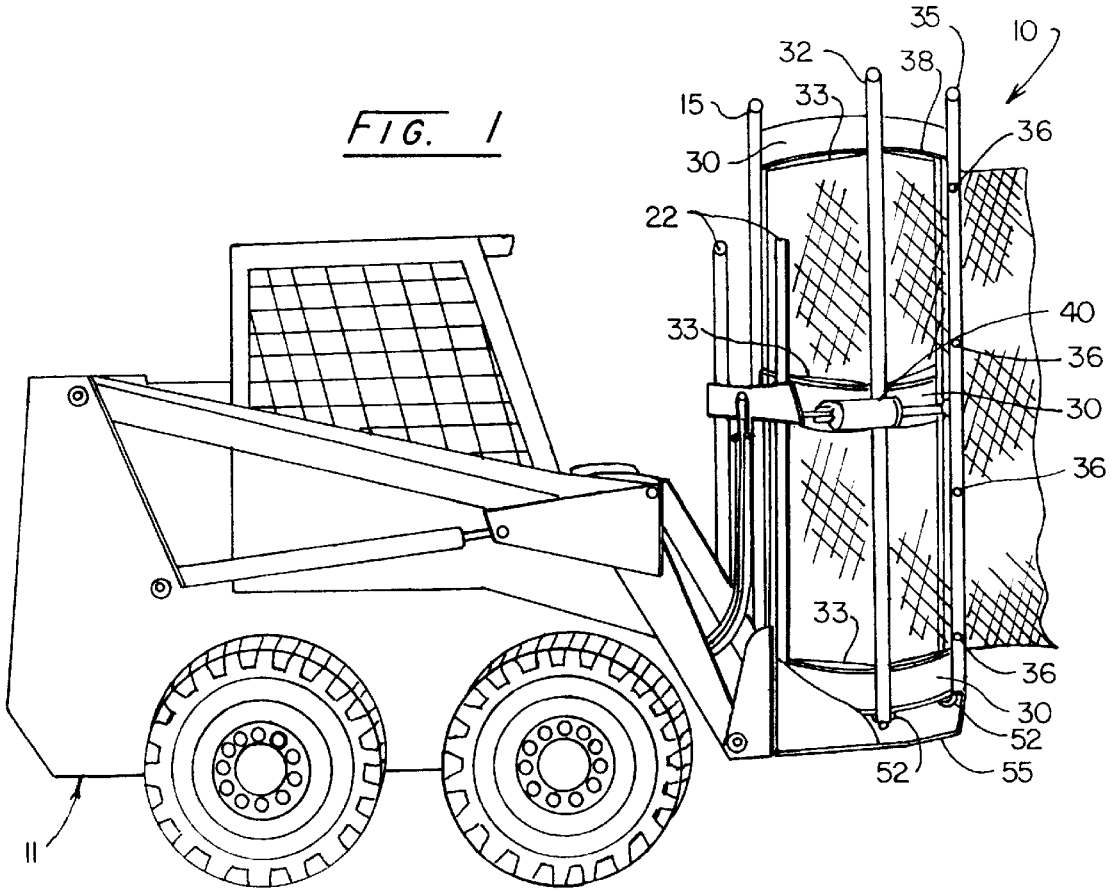
FIG. 1 is a side elevation of the fence handler containing a roll of chain link fence attached to the front end loader.

FIG. 1 shows the fence handler generally at 10 in operation unwinding fencing and attached to a front end loader shown generally at 11.

Figure 2:
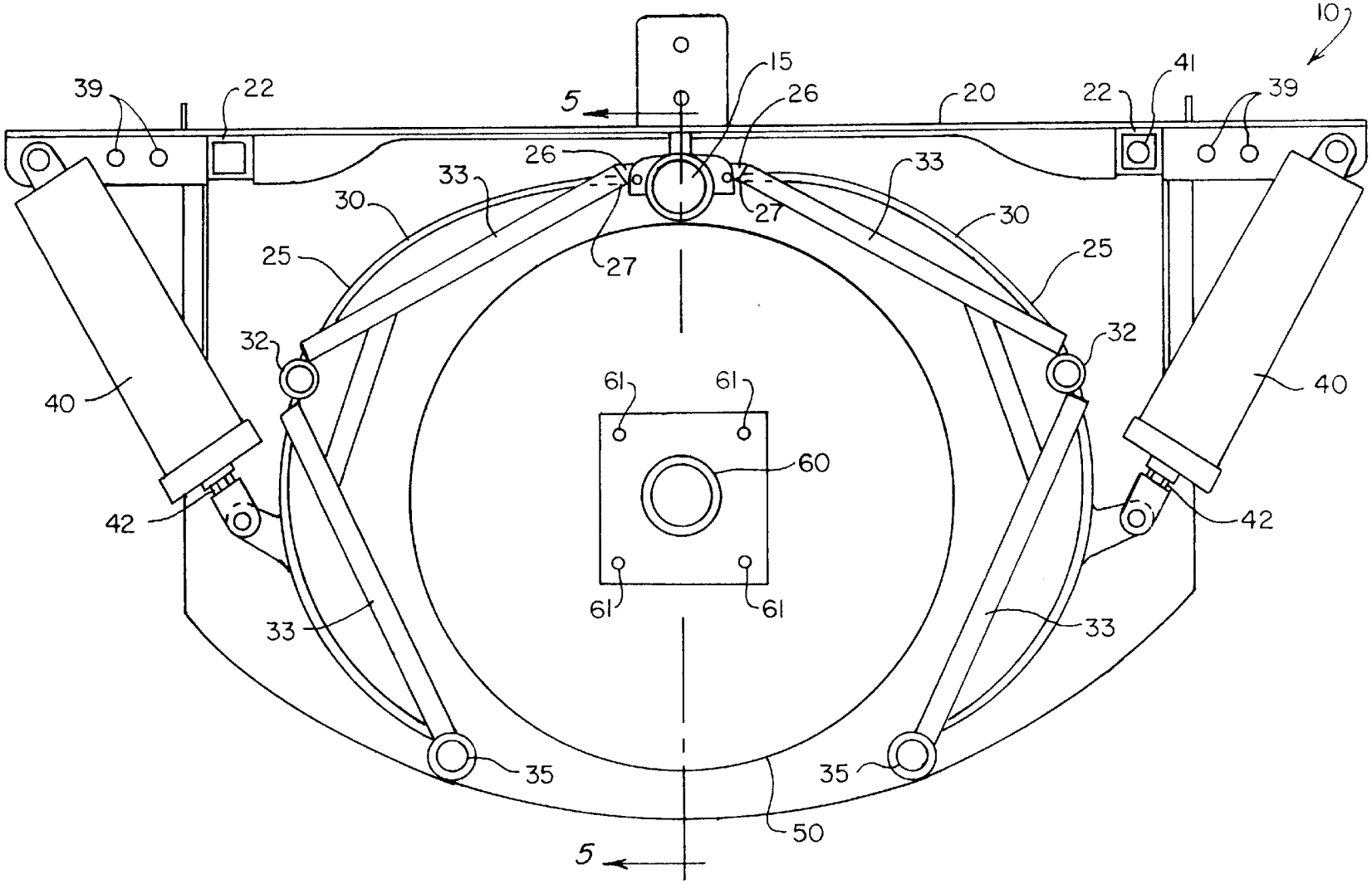
FIG. 2 is a top view of the fence handler with the gates in an open position to pick up a roll of chain link fence.

FIG. 2 shows the fence handler 10 in position to pick up a roll of chain link fence 12. A frame pole 15 is attached to a cross member 20. Frame supports 22—22 are also attached to cross member 20. The back edges 27—27 of gates 25—25 are connected to the frame pole 15 with hinges 26—26. The gates 25—25 have semicircular bands 30—30 attached to support poles 32—32. The bands 30—30 must be strong enough to support the heavy weight of a fencing roll. As shown, the bands 30—30 are reinforced with band supports 33—33.

Figure 3:
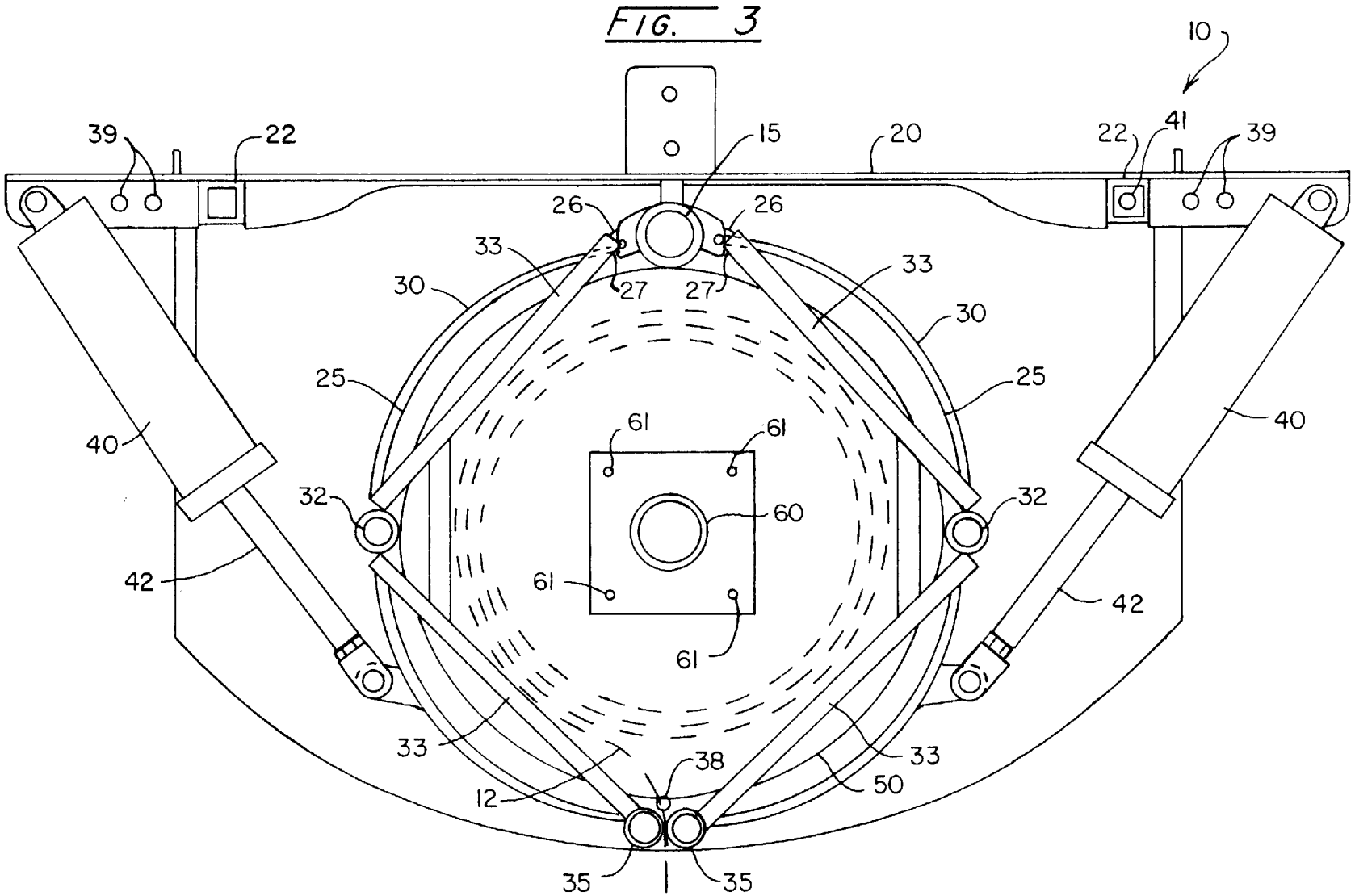
FIG. 3 is a top view of the fence handler with the gates in the closed position holding a roll of chain link fence.
Figure 4:
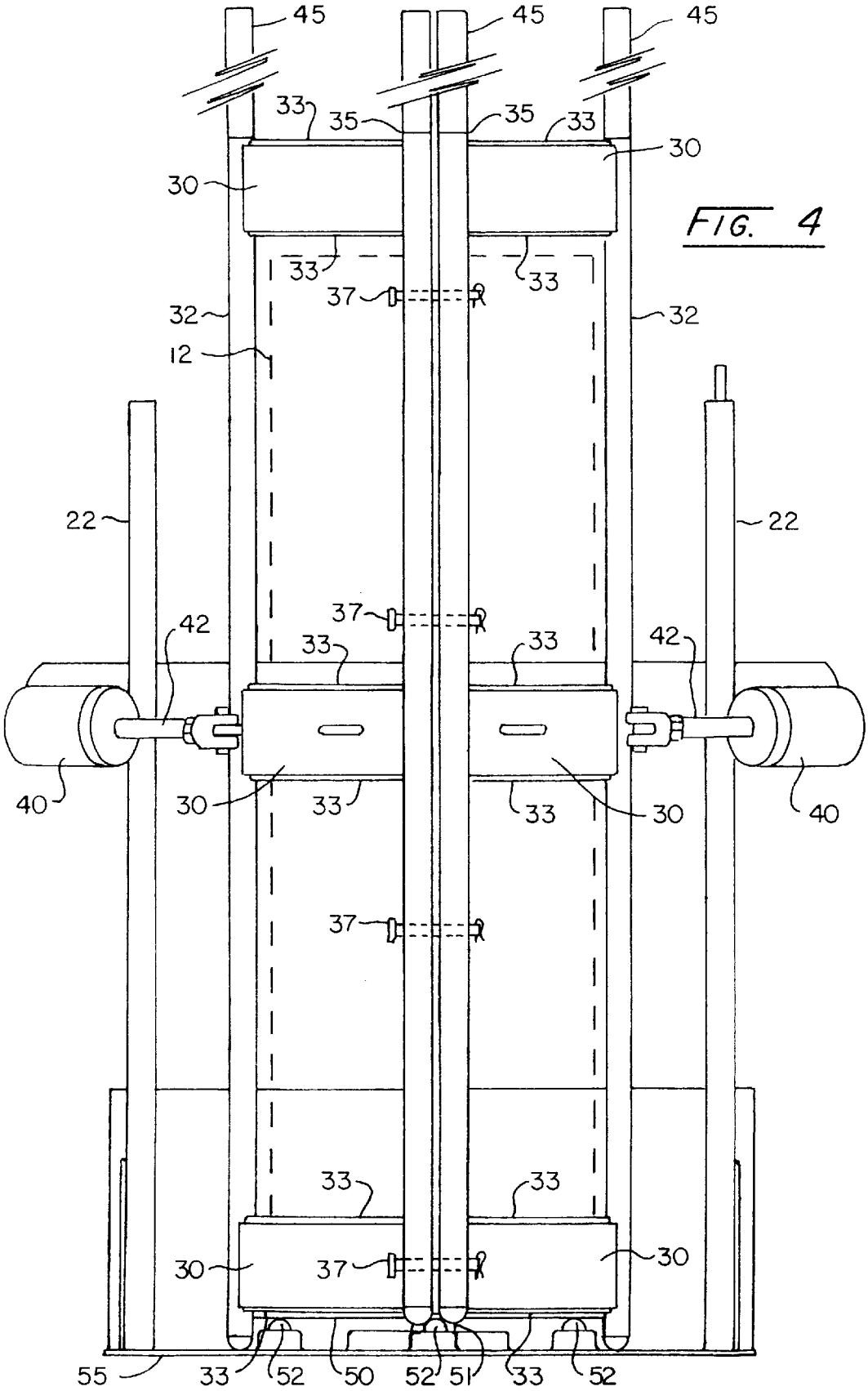
FIG. 4 is a front view of the fence handler.

At the front of the gates 25—25 are round tubes 35—35. As shown in FIG. 1, the round tubes 35—35 have matching holes 36—36 horizontally located therein. As shown in FIG. 4, pins 37—37, provided with hairpin keys to prevent the pins from falling out, may be inserted through holes 36—36 to hold round tubes 35—35 together during the fence stretching procedure. Hydraulic cylinders 40—40 are attached at one end to cross member 20, and at the other end to bands 30—30. In the open position shown in FIG. 2, the pistons 42—42 are retracted. As the pistons 42—42 extend, the gates are forced to a closed position, as shown in FIG. 3.

After an appropriate amount of fence has been unwound, it needs to be stretched. At this time, the pins 37—37 are inserted in the round tubes 35—35 and a tension bar 38, as shown in FIG. 1, is inserted down through the loops of the fence behind the round tubes 35—35. By backing the front-end loader 11, the fencing, which has been unwound, can then be tightened with the pins 37—37 preventing the tension bar 38 and the balance of the fence from being pulled through the space between the round tubes 35—35. The tension bar may be in the form of a six foot by three-quarter inch steel bar. When not in use, the pins 37—37 can be stored in the holes 39—39 as shown in FIGS. 2 and 3, and the steel bar 38 can be stored in the hole 41 provided in one of the frame supports 22—22.

The opening and closing of the gates can be controlled in other ways, such as with pneumatic cylinders attached to air tanks. However, the use of an hydraulic system is preferred, since it can be connected to the hydraulic system on the front-end loader 11.

The fence handler 10 can then be moved to a vertical position by the front end loader 11 using its conventional equipment so that the fencing can be attached to the posts. FIG. 4 shows the fence handler 10 in an upright position. The support poles 32—32, and upper, middle, and lower bands 30 can be seen. Optional extenders 45—45 maybe attached to round tubes 35—35 and to support poles 32—32 so that fencing which is taller than the fence handler 10 can be easily controlled.

Figure 5:
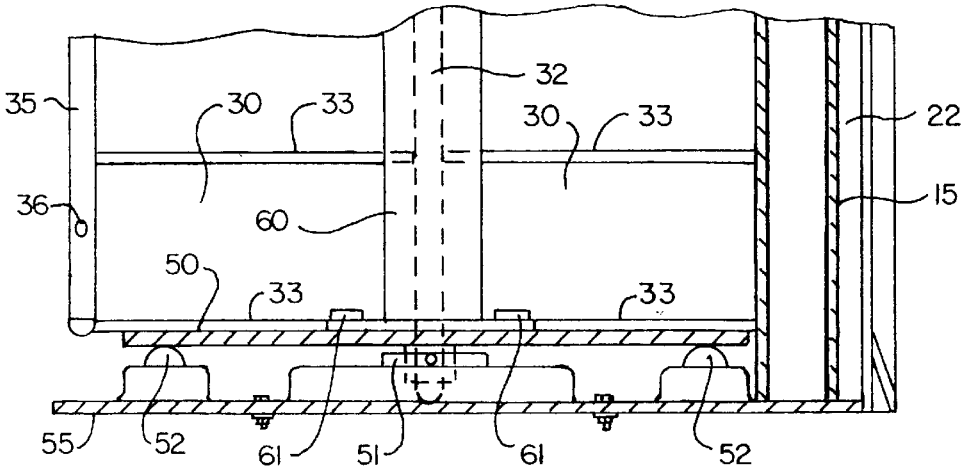
FIG. 5 is a cross-sectional view of the bottom portion of the fence handler on line 5—5 of FIG. 2

FIG. 5 shows the bottom of the fence handler. There is a bottom plate 50 attached to frame bottom 55 at connector 51. The bottom plate 50 preferably rotates on ball bearings 52—52 so that the wire fence will unroll easily. FIG. 5 also shows an optional pin 60 which can be attached to the bottom plate 50 by means of bolts 61—61. Pin 60 can be used with fencing having a center hole.

While a preferred form of the invention has been shown in the drawings and described, since variations in the preferred form will be apparent to those skilled in the art, the invention should not be construed as limited to the specific form shown and described, but instead is as set forth in the following claims.

What is claimed is:

1. An apparatus for unrolling fencing, said apparatus being capable of functioning in cooperation with a self-propelled machine provided with a main lifting and pushing frame having a flat normally horizontal portion and means for lifting and tilting said main lifting and pushing frame, said apparatus comprising:

a frame having an upright support and a bottom, first and second gates, each of said gates having a back edge and a front edge, the back edge of each of said gates being hingedly connected to said frame of said apparatus such that each of said gates is moveable between an opened position and a closed position, each of said gates having the front edge positioned opposite the back edge, and the front edge of said first gate being positioned adjacent to the front edge of said second gate when said gates are in the closed position, hydraulic cylinders, each of said hydraulic cylinders including a piston for moving a respective one of said gates between said opened position and said closed position, each of said cylinders being attached at one end to said frame of said apparatus and each of said pistons being attached to said respective one of said gates, a rotatable bottom plate attached to said frame bottom, a pin attached to said rotatable bottom plate whereby a roll of fencing having a center hole can be placed on said rotatable bottom plate over said pin to be unwound, an adapter attached to said frame of said apparatus for attachment to said self-propelled machine, said front edges of said first and second gates being provided with a plurality of holes so positioned that said holes in said front edges of said first and second gates are aligned when said gates are in said closed position, and pins of a size to fit through said holes in said front edges of said gates, whereby said apparatus is of a size and shape so as to be capable of being removably mounted on said flat normally horizontal portion of said main lifting and pushing frame of said self-propelled machine.

2. A method of unrolling wire fencing from a roll and positioning said fencing for attachment to fence poles comprising:

picking up said roll of wire fencing in an apparatus having a frame, first and second gates, each of said gate having a back edge and a front edge, the back edge of each of said gates being hingedly connected to said frame such that each of said gates is moveable between opened an and position, closed a position; each of said gates having the front edge positioned opposite the back edge the front edge of said first gate being positioned adjacent to the front edge of said second gate to form a gap and a bottom plate attached to said frame;

positioning said gates so that said gap is of a size to allow said fencing from said roll of wire fencing to pass through said gap;

unrolling an appropriate amount of said wire fencing from said roll of wire fencing through said gap;

positioning said gates so that the front edges of said gates engage said wire fencing;

inserting a plurality of pins each horizontally through the front edges of said gates; and inserting a tension bar vertically through said wire fencing disposed inside said gates between said roll of wire fencing an said pins, so that said front edges of said gates and said pins hold said tension bar in place, and thus hold said wire fencing from movement beyond said gates, so that wire fencing which has been unrolled is adapted to be tightened against said fence pole.

3. The method of claim 2 further comprising placing the apparatus horizontally over the roll of wire fencing closing the gates around the roll, and tilting the roll to a vertical position.

* * * * *